United States Patent [19]

Eldridge

[11] Patent Number: 4,721,038

[45] Date of Patent: Jan. 26, 1988

[54] STATION FOR FORMING STACKS OF FOLDED CARTONS

[75] Inventor: Charles W. Eldridge, Beverly, Mass.

[73] Assignee: Post Machinery, Inc., Portsmouth, N.H.

[21] Appl. No.: 921,748

[22] Filed: Oct. 22, 1986

[51] Int. Cl.[4] ..... B30B 9/30

[52] U.S. Cl. ..... 100/8; 414/88; 100/26

[58] Field of Search ..... 414/33, 45, DIG. 907, 414/88, 82, 91; 100/151, 26, 7, 8

[56] References Cited

U.S. PATENT DOCUMENTS

| | | | |
|---|---|---|---|
| 2,466,544 | 4/1949 | Harred | 414/45 X |
| 3,525,444 | 8/1970 | Brockmuller | 414/88 |
| 3,683,758 | 8/1972 | Feldkamper | 414/91 X |
| 3,970,202 | 7/1976 | Speggiorin et al. . | |
| 4,262,587 | 4/1981 | Russell | 100/26 X |
| 4,264,255 | 4/1981 | Saro et al. . | |
| 4,271,755 | 6/1981 | Kintgen et al. | 414/82 |
| 4,474,521 | 2/1983 | Jaton . | |

FOREIGN PATENT DOCUMENTS 3304673 2/1983 Fed. Rep. of Germany .

OTHER PUBLICATIONS

Jagenberg, Technical Information, I/154, Collator-Stacker SB-1.

*Primary Examiner*—Andrew M. Falik

*Attorney, Agent, or Firm*—Fitch, Even, Tabin & Flannery

[57] ABSTRACT

A stacking station for positioning between the output of machinery for forming folded cartons, and a strapping machine for applying a strap about the stack of the folded cartons to form a bundle. The stacking station includes an upstream conveyor receiving the cartons from the machinery with the upstream conveyor having an input end disposed at substantially the same level as the output of the machinery, and an output end which is vertically adjustable. The station further includes an intermediate conveyor for moving stacks of cartons toward the strapping machine and having a receiving end aligned to receive cartons from the upstream conveyor with the receiving end being disposed at a lower level than the output end of the upstream conveyor. The station also includes a gate associated with the intermediate conveyor and defining with the intermediate conveyor a pocket for forming a stack of the cartons. The gate is positioned to define the downstream end of the pocket. The gate is movable between a blocking position wherein it extends above the intermediate conveyor a distance greater than the height of the stack to be formed and a release position in which the gate does not interfere with movement of a formed stack toward the strapping machine. A method of stacking folded cartons using the stacking station is also disclosed.

11 Claims, 7 Drawing Figures

STATION FOR FORMING STACKS OF FOLDED CARTONS

The present invention relates to machinery for handling articles and, more particularly, to a stacking station for receiving the output of carton forming machinery to assemble stacks to be bundled at a downstream strapping machine.

BACKGROUND OF THE INVENTION

It is common practice to use two workers between the output of a production line which forms flat, folded cartons from carton blanks by folding and gluing, and a strapping machine for applying a strap about a stack of cartons for forming a bundle. The production line provides a constant series flow of folded cartons in shingle fashion, where the cartons are inclined due to overlapping. As one worker moves an assembled stack to the strapping machine and exercises the necessary care for placing the stack in the machine prior to its operation, the other worker separates the flow of shingled cartons at the output of the line and forms the next stack to be bundled.

Various fully automated stacking stations are available. These machines are complicated, expensive and may require a relatively long set up time to undergo various adjustments in preparation for performing a run of cartons having different parameters than the cartons stacked in a previous run. It is typical for a production run to be 5,000 to 10,000 cartons with the output of the production line being 5,000 per hour. Thus, it will be appreciated that it is important to keep the set up time as short as possible for efficient utilization of machinery and personnel. These automated stacking stations include exotic features such as means for rotating the cartons forming the first half of the stack to be formed through 180 degrees and placing them over the second stack half so that the top surface of the stack is parallel to the bottom surface (to compensate for slight differences in thicknesses at the ends of the cartons). For further information regarding the structure and operation of such prior art stacking machinery, reference may be made to U.S. Pat. Nos. 4,474,521; 4,264,255 and 3,970,202 and German Patent No. 3,304,673.

SUMMARY OF THE INVENTION

Among the several aspects and features of the present invention may be noted the provision of an improved semi-automatic stacking station for use with a production line for forming cartons. The stacking station can be operated by a single worker and allows the worker to stay away from the strapping machine. The stacking station has relatively short set up time to adjust for a run of cartons having different parameters than in the previous run. Additionally, the station can be placed in a passive mode in which it does not stack cartons but functions as an extension of the production line so that specialty cartons, which are not adapted to semi-automated stacking, can be accommodated without removing the station from between the output of the line and the strapping machine. The stacking station functions to sense a bottom carton to be formed into a stack to stop a conveyor which moves a completed stack downstream. It further functions to sense a completed stack moving downstream to block further cartons from downstream movement. The stacking station of the present invention is reliable in use, has long service life and is relatively easy and economical to manufacture. Other aspects of the present invention will be in part apparent and in part pointed out hereinafter in the specification and attached drawings.

Briefly, a stacking station embodying various aspects of the present invention includes an upstream conveyor for receiving cartons from the production line. The upstream conveyor includes an input end disposed at substantially the same level as the production line, and an output end which is vertically adjustable. The station also includes an intermediate conveyor for moving stacks towards a strapping machine with this conveyor having a receiving end aligned to receive cartons from the upstream conveyor section and with the receiving end being disposed at a lower level than the output end of the upstream conveyor. The stacking station also includes a gate associated with the intermediate conveyor and defining with the intermediate conveyor a pocket for forming a stack of cartons. The gate is positioned to define the downstream end of the pocket. The gate is movable between a blocking position wherein the gate extends above the intermediate conveyor a distance greater than the height of the stack to be formed, and a release position wherein the gate does not interfere with movement of a formed stack towards the strapping machine.

As a method, the present invention includes the following steps:

(a) the number of cartons to be formed into a stack is determined;

(b) after cartons to be at the bottom of a stack are blocked by the gate, the last carton to be in the stack is identified and the last carton and intermediate cartons are moved from the upstream conveyor into the pocket at a greater speed than the delivery rate of the production line; and (c) the gate is moved to its release position when the last carton is received in the pocket.

BRIEF DESCRIPTION OF THE DRAWINGS

Corresponding reference characters indicate corresponding components throughout the several views of the drawings.

DESCRIPTION OF THE PREFERRED EMBODIMENT

Figure 2:
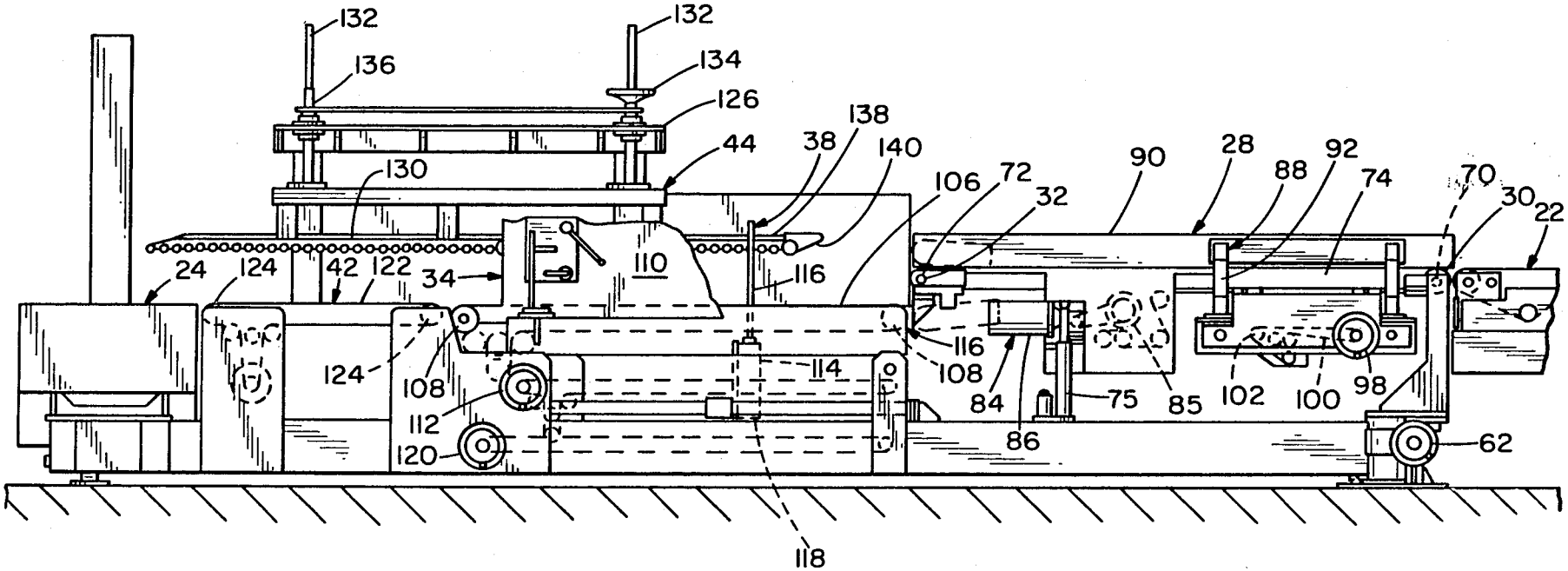
FIG. 2 is a left side elevational view showing the station of FIG. 1 disposed between the output of a production line for supplying the folded cartons and a strapping machine, with certain components broken away to expose other components.
Figure 5:
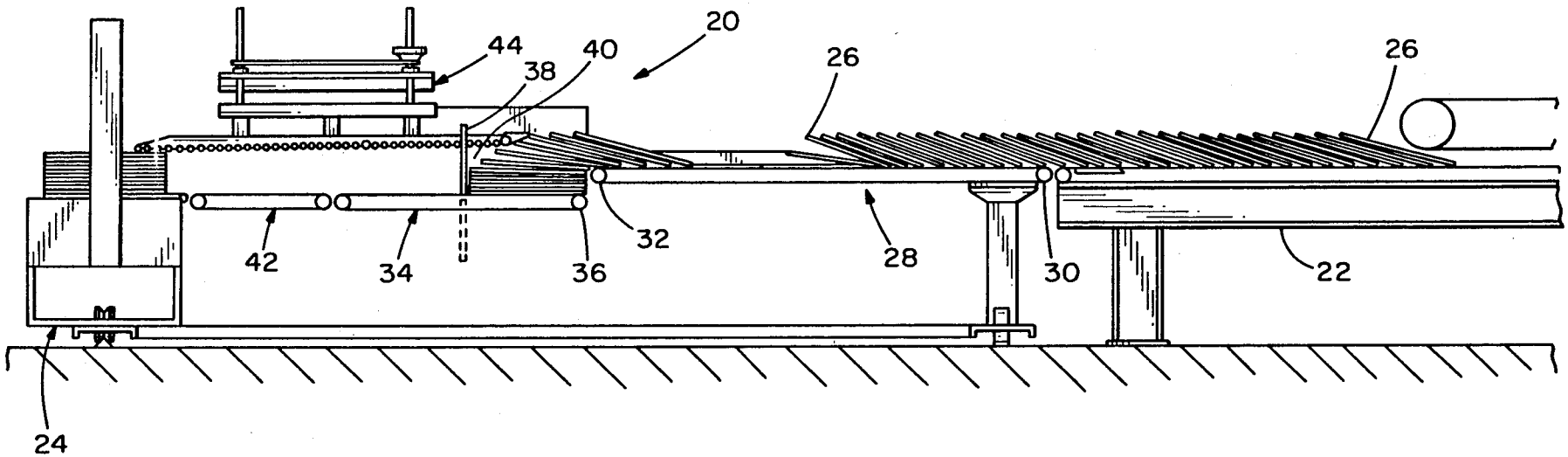
FIG. 5 is a simplified side elevation view of the station, illustrating the shingle-form output of the production line, the formation of a number of cartons into a stack, and the application of a strap about a stack at the strapping machine.

Referring now to the drawings, a station for forming stacks of cartons is generally indicated by reference numeral 20. As best shown in FIG. 2, the stacking station is positioned between the output 22 of a production line which forms flat, folded cartons from carton blanks by folding and gluing, and a strapping machine 24 for applying a strap about a stack of cartons to form a bundle. An example of such a folder-gluer in Model 74 CORR. made by Post Machinery Company, Inc. of Portsmouth, N.H. An example of such a strapping machine is Model ML made by Signode Corp. of Glenview, Ill. Referring to FIG. 5, the output 22 of the production line provides a constant series flow of folded cartons 26 in shingle fashion, where the cartons are inclined due to overlapping. The station 20 includes an upstream conveyor 28 receiving the cartons from the output. Conveyor 28 has an input end 30 disposed at substantially the same level as the output 22, and further has a vertically adjustable output end 32. Station 20 also includes an intermediate conveyor 34 for moving stacks of cartons 26 toward the strapping machine 24. Intermediate conveyor 34 has a receiving end 36 aligned to receive cartons from the upstream conveyor, with the receiving end usually positioned at a lower level than the output end 32 of the upstream conveyor 28.

A gate 38 is associated with the intermediate conveyor 34 and defines with conveyor 34 a pocket 40 for forming a stack of cartons. The gate, which may be formed by vertically extendable and retractable piston rods of air cylinders, defines the downstream end of the pocket. When the gate is in its blocking position (shown in FIG. 5), it extends above the intermediate conveyor a distance greater than the height of the stack to be formed. The gate can be retracted to a release position in which it does not interfere with movement of a formed stack toward the strapping machine.

Further included in station 20 is a downstream conveyor 42 positioned between the intermediate conveyor 34 and the strapping machine 24. A generally horizontally extending compressor 44 overlies the intermediate conveyor and forms the top of the pocket 40. The compressor 44, which functions to stabilize a formed stack, extends over the downstream conveyor 42 to the strapping machine.

Figure 1:
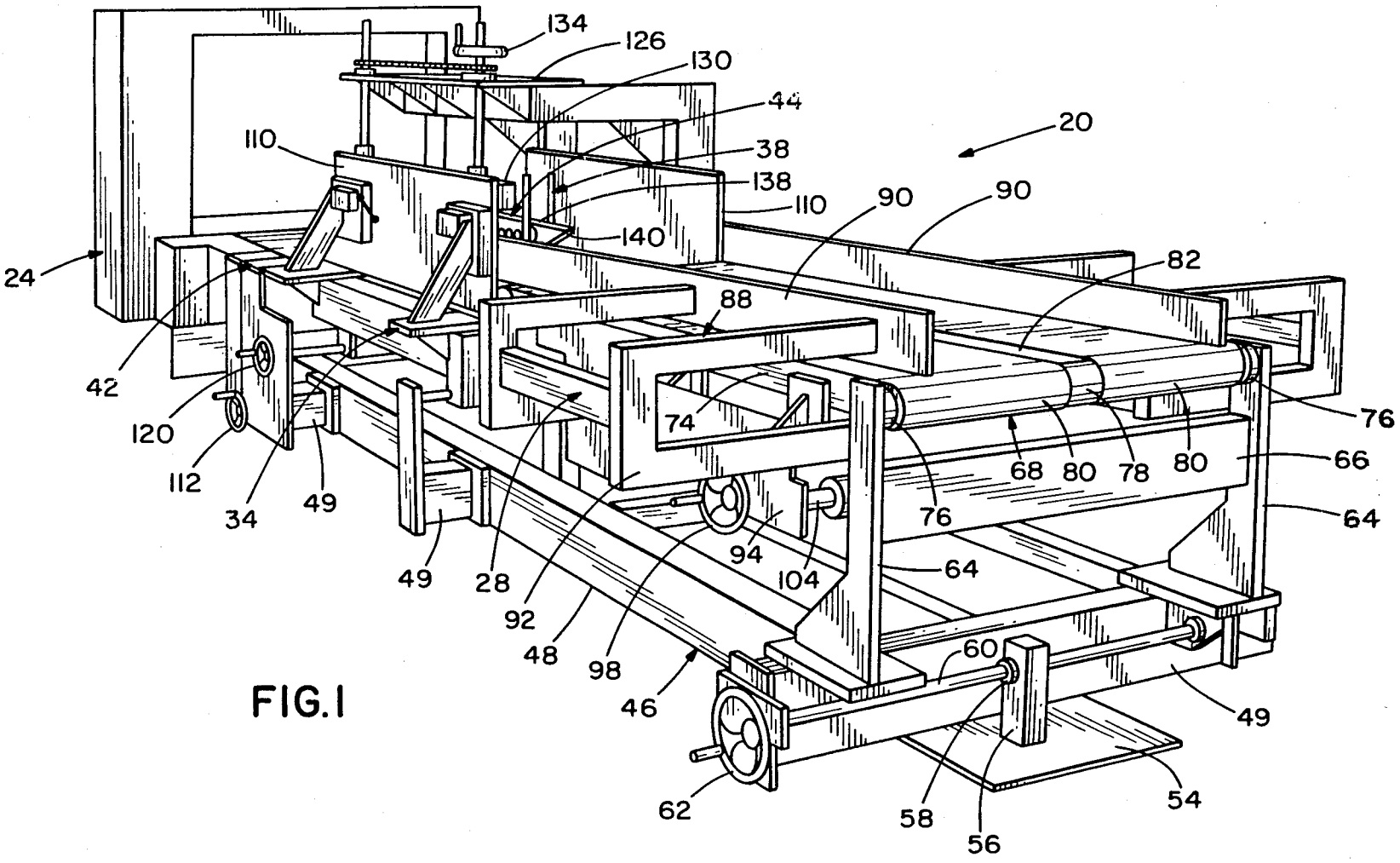
FIG. 1 is a perspective view of a station for forming stacks of folded cartons, embodying various features of the present invention.
Figure 3:
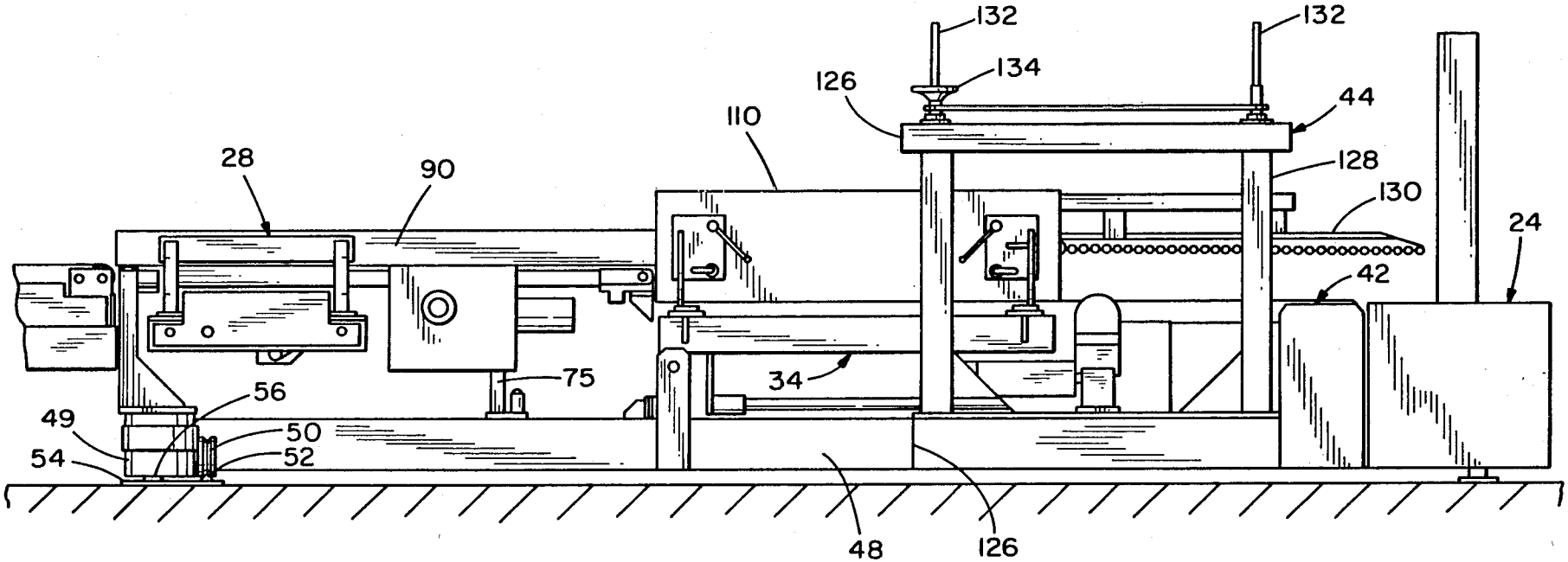
FIG. 3 is a right side elevation of the stacking station of FIG. 1.

More specifically, the stacking station 20 includes a frame 46 including a pair of spaced, longitudinally extending side beams 48, interconnected by a series of spaced cross beams 49. As best shown in FIG. 3, the station 20 is laterally movable as the forward cross beam 49 pivotally carries grooved wheels 50 riding on a transverse track 52 attached to the floor. Also attached to the floor (as best shown in FIG. 1) is the base 54 of a standard 56 non-rotatably carrying a threaded nut 58. The end portions of a transverse lead screw 60 have journals suitably supported by bearings carried by the side beams. The lead screw is threaded into the nut 58 and a hand wheel 62 is affixed to one end of the screw so that by operation of the handwheel, the station can be moved laterally. The formed cartons may be delivered by the output 22 off the centerline of the production line. It is necessary to align the stacking station so that the cartons are received at the centerline of the station so that the stacks of cartons are received at the centerline of the strapping machine.

Figure 4:
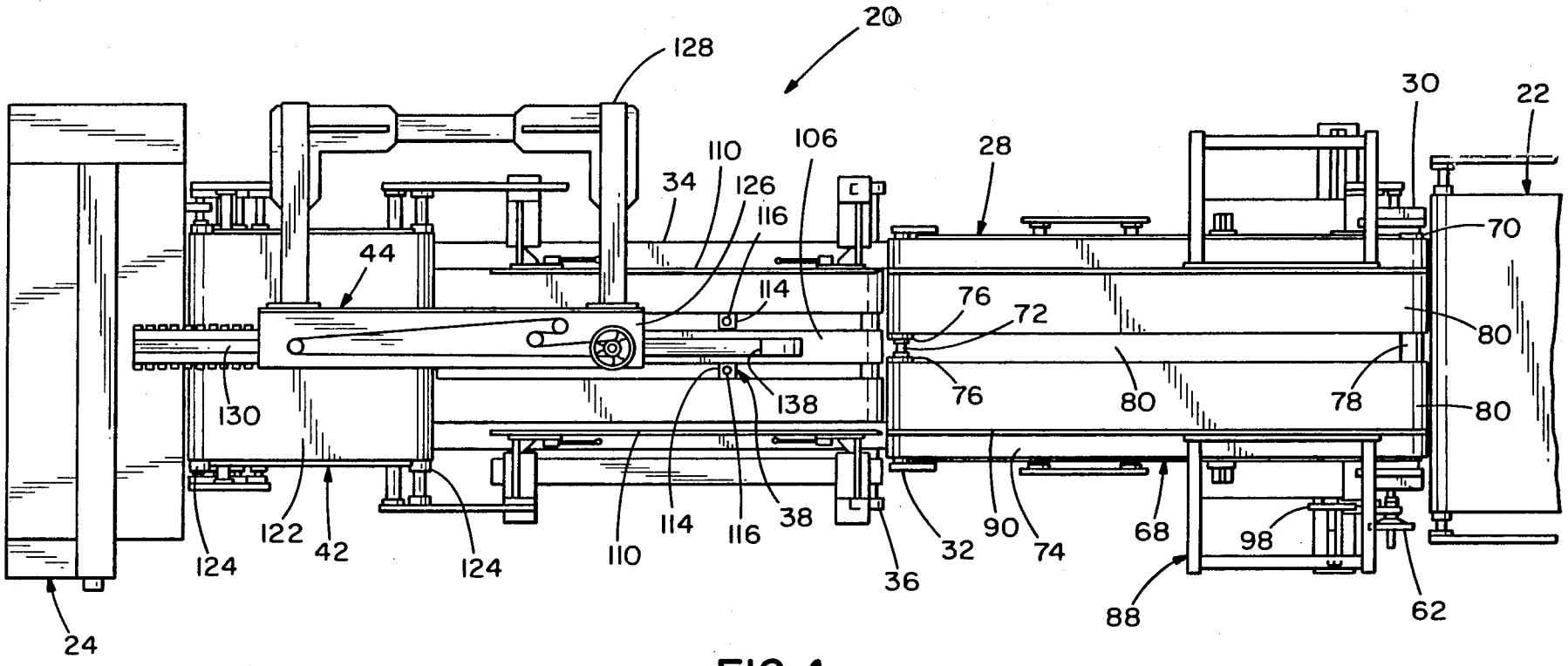
FIG. 4 is a plan view of the stacking station of FIG. 1.

Disposed at the forward or upstream end of upstream conveyor 28 are spaced vertical supports 64 mounted on the front cross beam 49 and interconnected by a transverse front brace 66. The supports pivotally carry the forward end of the upstream conveyor frame assembly 68 formed of a forward shaft 70, a rear shaft 72 and spaced side beams 74 having suitable bearings for supporting journals of shafts 72 and 74, as best shown in FIG. 4. The rear end of the frame assembly 68 can be varied in height by use of an electric jack 75 interconnecting a main side beam 48 and a side beam 74 of the upstream conveyor frame assembly. As shown in FIG. 1, each shaft 70, 72 rotatably carries two rollers 76 separated by a spacer 78. Two spaced conveyor endless belts 80 are trained about corresponding rollers 76 and define a central space 82 which may receive the hand of the operator when separating cartons prior to sweeping them into pocket 40 as will be discussed more fully hereinafter. Referring to FIG. 2, a drive assembly 84 for the belts 80 includes a pulley 85 driven by a dc variable speed motor 86 and various idler wheels for adjusting tension in the belts as will be understood by those of skill in the art.

The upstream conveyor 28 also includes a carton guide assembly 88 carried by side beams 74 and including spaced walls 90 disposed above the belts 80 for preventing transverse movement of the cartons 26 as they pass through the upstream conveyor. Each wall 90 is carried by bracket arms 92 held by a side panel 94 holding a threaded lug. A handwheel 98 is provided having sprocket teeth for engaging a chain 100 trained about sprocket wheel 102 carried by an adjusting screw 104 which has journals supported by bearings carried by assembly 88. The screw has two threaded ends with one thread being right-handed and the other left-handed. Each threaded end is received in the lug carried by its associated side panel 94. Thus when handwheel 98 is rotated in one direction, the side walls 90 come together, and separate when handwheel 98 is turned in the opposite direction.

The intermediate conveyor 34 has a single, centrally located conveyor belt 106 trained about end rollers 108 which are carried on shafts pivotally held by side beams of the intermediate frame assembly with the belt suitably driven at a fixed speed by a variable speed dc motor, as is well known by those of skill in the art. The intermediate conveyor 34 also includes a pair of side panels 110 flanking the conveyor belt 106. These side panels 110, similar to sidewalls 90, restrain lateral movement of the stacked cartons as they move through the intermediate conveyor. They are connected through a suitable drive train to a control handwheel 112 so that selective rotation of the handwheel closes or opens the side panels 110 to accommodate a particular carton width.

The gate 38 is formed by a pair of spaced air cylinders 114 arranged such that the piston rods 116 of the cylinders flank the conveyor belt 106 inside of the side panels 110. The air cylinders 114 are mounted on a carriage 118 which can reciprocate in the axial direction of the station 20. Axial positioning of the gate is controlled by a handwheel 120 carrying a sprocket holding a chain connected to the carriage 118. For example, when the gate is in its full upstream position, the pocket 40 may have an axial length of 6 inches for stacking the smallest cartons usable with the station. The carriage can be moved 42 inches downstream so that cartons having a maximum length of 48 inches can be accommodated in station 20.

Disposed between the intermediate conveyor 34 and the strapping machine 24 is the downstream conveyor 42 which includes a conveyor belt 122 trained about end rollers 124 which are rotatably held by the downstream flame assembly. The conveyor belt 122 is suitably driven by a dc variable speed motor, the operation of which is controlled by circuitry in the strapping machine.

Overlying the intermediate conveyor 34 and the downstream conveyor 42 is the compressor 44 which functions to stabilize the stacked cartons moving toward the strapping machine. The compressor, as best shown in FIG. 3, is suspended from a horizontal wall 126 connected to one of the frame side beams 48 through a support structure 128 including lower transverse beams affixed to the side beam 48, upper transverse beams holding the wall 126, and vertical supports joining the upper and lower transverse beams.

Compressor 44 is both vertically adjustable and can be extended in the axial direction of the station 20. The compressor includes a horizontal bar 130 having bearings supporting journals at the ends of spaced, vertical lead screws 132 threaded through lugs carried by the horizontal wall 126. Affixed to one lead screw is a handwheel 134 having sprocket teeth and the other lead screw carries a sprocket wheel 136. A chain is trained about the teeth of the handwheel and sprocket wheel so that the vertical positioning of the horizontal bar 130 can be adjusted through operation of the handwheel 134. The bar 130 preferably holds spaced rows of freewheeling rollers which sequentially engage the top carton of a formed stack of cartons 26 as it moves toward the strapping machine, as shown in FIG. 5.

The horizontal bar 130 preferably has a dovetail guide way receiving a dovetail extension bar 138. Ball bearings are provided in the guide way for reducing friction. The extension bar also carries dependent rollers, at the the same level as the rollers of the horizontal bar, for engaging the top cartons of the stacks. Clamping means are provided for locking the extension bar after it has been adjusted so that it extends upstream of the gate 38. The upstream end of the extension bar preferably has a ramp surface 140 for guiding the cartons 26 beneath the extension bar as they are swept into the pocket 40 from the upstream conveyor 28.

Figure 6:
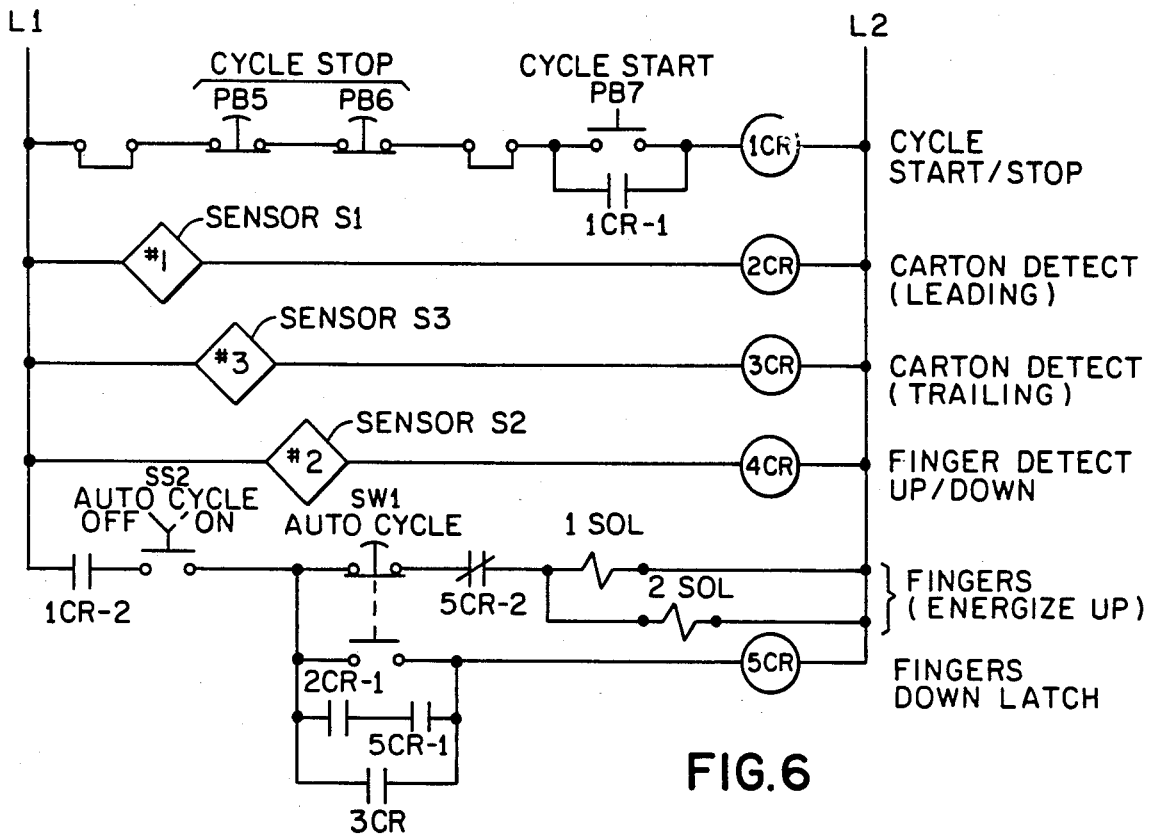
FIG. 6 is a schematic diagram illustrating the control of various drives in the station by various sensor and controls.

Referring to the schematic diagram of FIG. 6, the station 20 includes a trio of proximity sensors S1, S2, and S3 and an operator controlled switch such as handswitch SW1 interconnected with the air cylinder controller and the speed control for the dc motor operating the intermediate conveyor belt 106. The proximity sensors are preferably photoelectric background suppression scanners which function to detect the presence of an object at only a predetermined range of distances from the scanner. This scanner ignores object movement beyond the range and also short of the range. Thus, the presence of dust on the scanner lenses does not effect its operation. An example of such a scanner is model F4A-04 by Data Logic.

The first proximity sensor S1 is positioned to detect when the first carton enters the pocket 40 to stop the drive for the intermediate conveyor belt 106. When the top carton of the stack is positioned underneath the extension bar 138 of the compressor 44, the operator actuates switch SW1 which causes the piston rods 116 to retract (gate 38 to lower). The second proximity sensor S2 is positioned to detect the gate approaching its retracted position to start the drive for the belt 106 to move the completed stack to the strapping machine. The last sensor S3 is positioned to detect the trailing edge of the stack moving downstream of the gate and operates to extend the pistons of the air cylinders (raise the gate).

The production line folder-gluer has a feature whereby the cartons can be marked at predetermined intervals. This is usually accomplished by applying a type of water mark to cartons at predetermined regular intervals, and the mark is visible to the operator under a fluorescent light.

The station 20 of the present invention is very versatile as it can accommodate many types of cartons of many different sizes. It can be used with "lock bottom" cartons which have sides of different thickness. In forming a stack of these lock bottom cartons, one-half of the carton in the stack must be rotated through 180° to compensate for the differences in thicknesses so that the top of the stack will be horizontal. The station also can be placed in a passive mode to accommodate special cartons which are too delicate or for some other reason cannot be stacked. In this passive mode, the station 20 simply functions as an extension of the production line and the operator manually removes the cartons in shingle form at the output of the downstream conveyor. To place the station 20 in this passive mode, the three dc motors for upstream conveyor 28, intermediate conveyor 34, and downstream conveyor 42 are set to operate at the same speed. Additionally, the electric jack 75 is operated to drop the output end 32 of the upstream conveyor frame 68 to the level of the intermediate conveyor 34.

One of the main advantages of the station 20 is its ability to undergo very fast adjustments to undertake a production run of a different size of folded cartons. It has been found that the necessary adjustments can be completed within about five minutes. Minimizing the downtime required for adjustment for a new production run is very important particularly in view of the fact that a typical production run is only five to ten thousand cartons which the production line can complete in an hour or two.

To set up the station 20 for a new production run, it is first necessary to determine where with respect to the centerline of the production line the cartons will be positioned. The station 20 is laterally adjusted to be aligned with the flow of the cartons by the use of the handwheel 62. Next the upstream walls 90 are adjusted so that their spacing is just slightly greater than the carton width. This is done by placing a sample carton between the sidewalls and then operating handwheel 98 until the sidewalls 90 just touch the carton edges at which point the side walls are backed off about one-eighth inch. Next the downstream end of the upstream conveyor is adjusted for height using the electric jack 75. It has been found that for the lock bottom type of cartons, where one half of the stack of the cartons to be stacked must be rotated, it is best to have the downstream end 32 of the upstream conveyor 28 above the level of the intermediate conveyor by a distance of about one half the height of the stack. For other types of cartons where no rotation is necessary, it is suggested that the downstream end of the conveyor be dropped to about the level of the intermediate conveyor. A fourth adjustment has to do with the intermediate side panels 110. This adjustment is made in the same manner as the upstream side panels, using the control handwheel 112.

The carriage 118 for the gate cylinders 114 is next adjusted for the length of the cartons. This is effected using the handwheel 120 to move the carriage the proper distance. The next adjustment is the vertical adjustment of the compressor 44 through the use of the handwheel 134. Adjustment is made for the extension bar 138 so that it extends over the pocket 40 by two or three inches. After this is set, the clamp is tightened to lock the extension bar in position. With only these few adjustments, the station 20 can be readied for the next production line of cartons 26 of different size from those made in the previous run.

Assume that lock bottom cartons are to be stacked with the stack having 16 cartons. The indicator mechanism of the production line folder-gluer is set to provide a mark on every eighth carton. The operator stands at the downstream end of the upstream conveyor 28 and identifies the eighth carton. He lifts the overlapping leading edge of the ninth carton and at this time places his hand in the space 82 between the conveyor belts 80 allowing him to sweep the downstream eight cartons into the pocket 40 after rotating them 180°. The first carton entering the pocket 40 will be detected by the first sensor S1 to turn off the drive of the intermediate conveyor 34. The operator then identifies the last carton to be in the stack, lifts the first carton 26 of the next stack and sweeps the downstream eight cartons on the upstream conveyor 28 into the pocket 40 with the top carton being disposed beneath the extension bar 138. The operator then actuates the switch SW1 causing the gate 38 to drop. The second sensor S2 turns on the intermediate conveyor drive causing the stack to advance to the strapping machine 24. When the third sensor S3 detects passage of the trailing end of the formed stack, it controls operation of the air cylinders 114 to raise the gate 38 so that the operator can start the formation of a subsequent stack.

Figure 7:
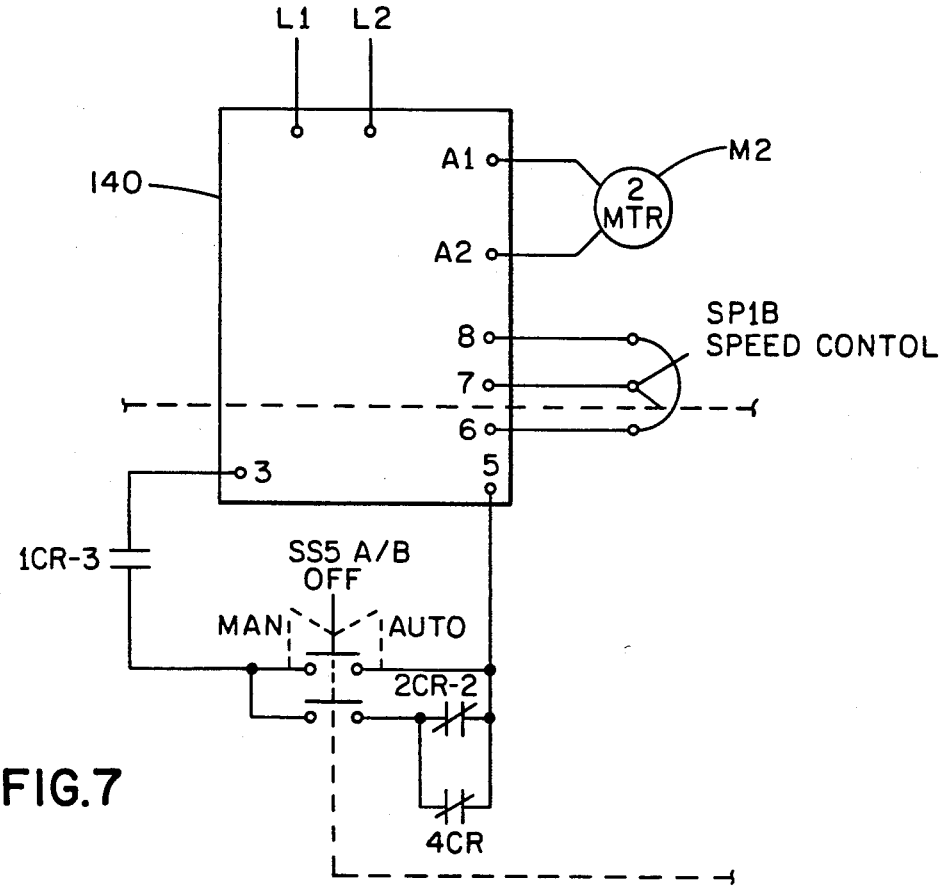
FIG. 7 is a schematic diagram showing various controls connected to a drive for a dc motor.

More specifically, FIG. 6 is a schematic diagram showing a control circuit including the sensors S1, S2 and S3. FIG. 7 illustrates control connections for a dc drive 140 controlling operation of the dc motor M2 driving the intermediate conveyor 34. An example of such a drive is Model Focus I by Emerson Electric Corp. of St. Louis, Mo. It will be appreciated that establishment of a conductive path between terminals 3 and 5 of drive 140 results in the motor M2 running at a speed determined by the setting of the variable resistance network connected to terminals 6, 7, and 8 of drive 140. Various running lights and emergency shutdown controls have been deleted from FIG. 6 to simplify the circuitry. When sensor S1 detects a carton in pocket 40, it energizes the coil of relay 2CR. When the piston rods 116 forming gate 38 have been retracted, sensor S2 deenergizes the coil of relay 4CR. When sensor S3 detects the passage of a stack of cartons, it energizes the coil of relay 3CR. It is noted that sensors S1 and S2 are positioned sufficiently close to each other that they both detect a stack of cartons moving from the pocket 40 before the stack moves fully downstream of the pocket. The energization of solenoids 1 SOL. and 2 SOL. causes piston rods 116 to extend. Deenergization of the solenoids causes the rods to retract (gate 38 to drop).

Actuation of momentary close cycle start PB7 energizes the coil of relay 1CR causing the contacts 1CR-1 to close, shunting PB-7 to seal in relay 1CR. With switch SS5 set in its "AUTO" position, the closure of contacts 1CR-3 causes the drive 140 to start motor M2 because normally closed contacts 2CR-2 of relay 2CR complete a closed path between terminals 3 and 5 of the controller 140. The first carton entering pocket 40 is detected by sensor S1 which energizes the coil of relay 2CR causing contacts 2CR-2 to open resulting in motor M2 stopping. After the operator has completed formation of the stack in pocket 40, he actuates momentary close switch SW1 and (assuming switch SS2 is set to "AUTO CYCLE") the coil of relay 5CR is energized. As contacts 2CR-1 are closed, the closure of contacts 5CR-1 seal in the coil of relay 5CR. The opening of normally closed contacts 5CR-2 drop out solenoids 1 SOL. and 2 SOL. resulting in opening of the gate 38.

Upon detection of the gate 38 dropping, sensor S2 deenergizes the coil of relay 4CR, causing contacts 4CR to close. Thus, a conductive path between terminals 3 and 5 of drive 140 is reestablished and motor M2 is restarted. As the stack begins moving by the gate, the sensor S3 detects the leading edge of the stack to energize the coil of relay 3 CR. This closes contacts 3CR (which shunt the series combination of contacts 2CR-1 and 5CR-1) to maintain energized the coil of relay 5CR, to keep the gate down, after the stack moves out of the pocket 40 causing sensor S1 to drop out the coil of relay 2CR which opens contacts 2CR-1 and closes contacts 2CR-2. When sensor S3 detects the trailing edge of the stack, the coil of relay 3CR is deenergized causing contacts 3CR to open. This results in deenergization of the coil of relay 5CR. The closing of contacts 5CR-2 energizes solenoids 1 SOL. and 2 SOL. causing piston rods 116 to extend (the gate 38 to close). Sensor S3 detects the up gate to energize the coil of relay 4CR which opens contacts 4CR. However, the motor M2 remains running because contacts 2CR-2, which parallel contacts 4CR, remain closed. After the stack reaches the downstream conveyor, the operator can begin formation of the next stack in pocket 40.

The upstream conveyor 28 is typically run at a speed within about 30% of the delivery rate of the production line. When the upstream conveyor is run at greater speed than the production line, the shingled cartons in the upstream conveyor have a greater spread than those delivered by the production line. On the other hand when the upstream conveyor is run at a slower speed than the production line, the shingled cartons have a lesser spread than those delivered by the production line.

As a method of stacking folded cartons formed by machinery which folds and glues carton blanks, the present invention includes several steps. First the number of cartons 26 to be formed into a stack is determined. Second, after the carton to be at the bottom of a stack is blocked by the gate 38, the last carton to be in the stack is identified and the last carton and intermediate cartons from the upstream conveyor are moved into the pocket 40. Finally, the gate is moved to its release position after the last carton in the stack is received in the pocket.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A stacking station adapted for disposition between the output of machinery for forming folded cartons by folding and gluing carton blanks, and a strapping machine for applying a strap about a stack of said folded cartons to form a bundle, said machinery providing a series of said cartons in shingle form with the cartons inclined and overlapped, said stacking station comprising:

an upstream conveyor for receiving the cartons from said machinery, said upstream conveyor having an input end disposed at substantially the same level as the output of said machinery and an output end which is vertically adjustable;

an intermediate conveyor for moving stacks of cartons toward said strapping machine and having a receiving end aligned to receive cartons from said upstream conveyor, said receiving end being disposed at a lower level than said output end;

gate means associated with said intermediate conveyor and defining with said intermediate conveyor a pocket for forming a stack of said cartons, said gate means being positioned to define the downstream end of said pocket, said gate means being movable between a blocking position wherein said gate means extends above said intermediate conveyor a distance greater than the height of the stack to be formed and a release position wherein said gate means does not interfere with movement of a formed stack toward said strapping machine, further comprising generally horizontally extending compression means overlying said intermediate conveyor, forming the top of said pocket and extending to at least adjacent to said strapping machine, so that the formed stacks engage said compression means and said compression means stabilizes the stacks and limits the height of the formed stacks as they move toward said strapping machine.

2. A stacking station as set forth in claim 1 wherein said compression means comprises a horizontal beam carrying a series of dependent freewheeling rollers sequentially engageable with the tops of said formed stacks.

3. A stacking station as set forth in claim 1 further comprising means for vertically adjusting said compression means.

4. A stacking station as set forth in claim 1 wherein said compression means has an upstream end with a guide for directing cartons beneath said compression means.

5. A stacking station adapted for disposition between the output of machinery for forming folded cartons by folding and gluing carton blanks, and a strapping machine for applying a strap about a stack of said folded cartons to form a bundle, said machinery providing a series of said cartons in shingle form with the cartons inclined and overlapped, said stacking station comprising:

an upstream conveyor for receiving the cartons from said machinery, said upstream conveyor having an input end disposed at substantially the same level as the output of said machinery and an output end which is vertically adjustable;

an intermediate conveyor for moving stacks of cartons toward said strapping machine and having a receiving end aligned to receive cartons from said upstream conveyor, said receiving end being disposed at a lower level than said output end;

gate means associated with said intermediate conveyor and defining with said intermediate conveyor a pocket for forming a stack of said cartons, said gate means being positioned to define the downstream end of said pocket, said gate means being movable between a blocking position wherein said gate means extends above said intermediate conveyor a distance greater than the height of the stack to be formed and a release position wherein said gate means does not interfere with movement of a formed stack toward said strapping machine, further comprising a downstream conveyor positioned between said intermediate conveyor and said strapping machine, said downstream conveyor having a driven belt.

6. A stacking station adapted for disposition between the output of machinery for forming folded cartons by folding and gluing carton blanks, and a strapping machine for applying a strap about a stack of said folded cartons to form a bundle, said machinery providing a series of said cartons in shingle form with the cartons inclined and overlapped, said stacking station comprising:

an upstream conveyor for receiving the cartons from said machinery, said upstream conveyor having an input end disposed at substantially the same level as the output of said machinery and an output end which is vertically adjustable;

an intermediate conveyor for moving stacks of cartons toward said strapping machine and having a receiving end aligned to receive cartons from said upstream conveyor, said receiving end being disposed at a lower level than said output end;

gate means associated with said intermediate conveyor and defining with said intermediate conveyor a pocket for forming a stack of said cartons, said gate means being positioned to define the downstream end of said pocket, said gate means being movable between a blocking position wherein said gate means extends above said intermediate conveyor a distance greater than the height of the stack to be formed and a release position wherein said gate means does not interfere with movement of a formed stack toward said strapping machine, wherein said intermediate conveyor includes a driven belt for moving stacked cartons, said station further comprising a first sensor means responsive to a carton approaching said gate means to stop said driven belt.

7. A stacking station as set forth in claim 6 further comprising a second sensor means responsive to a stack passing said gate means in its release position to move said gate means to its blocking position.

8. A stacking station as set forth in claim 7 further comprising a third sensor means responsive to said gate means approaching its release position to start said driven belt.

9. Semi-automatic apparatus for stacking and bundling the output from a folder-gluer which exits therefrom in shingled fashion upon a delivery conveyor, which apparatus comprises first conveyor means having an input end at a height matched to said delivery conveyor to receive a shingled group of articles, such as folded boxes, and having means for vertically adjusting the height of an outlet end thereof, second conveyor means located downstream from said outlet end of said first conveyor means and at a vertically lower level, adjustable gate means for disposition above said second conveyor means in a position to block movement of articles therealong and to create a pocket above said second conveyor means having a desired depth which is set by the adjusted height of said output end of said first conveyor, compression means overlying above said second conveyor means including a portion of said pocket, means for lowering and raising said adjustable gate means so as to alternately create and then dissolve said pocket, means for banding a stack of vertically aligned articles, and means simultaneously to move a stack of articles from the region of said dissolved pocket and delivering same to said banding means upon lowering of said gate means.

10. Apparatus in accordance with claim 9 wherein means are provided for increasing or decreasing the effective length of said compression means so that it extends an appropriate distance into the region above said pocket.

11. Apparatus in accordance with claim 9 including sensor means for detecting the presence of an article in said pocket and means connected to said sensor for halting movement of said second conveyor means upon such detection when said gate means is in its raised position.

* * * * *